United States Patent [19]

Hunt

[11] Patent Number: 4,710,144

[45] Date of Patent: Dec. 1, 1987

[54] WATER SKIS AND THE LIKE

[76] Inventor: John Hunt, 2 Crackstone Cottage, Stroud Minchinhampton Gloucestershire, Great Britain

[21] Appl. No.: 771,555

[22] Filed: Aug. 30, 1985

[30] Foreign Application Priority Data

Sep. 11, 1984 [GB] United Kingdom ..... 8422952

[51] Int. Cl.[4] ..... B63H 5/06

[52] U.S. Cl. ..... 441/79

[58] Field of Search ..... 114/126, 127, 128, 140, 114/144 R, 162, 245, 274; 441/68, 74, 79; 440/66

[56] References Cited

U.S. PATENT DOCUMENTS

| | | | |
|---|---|---|---|
| 3,319,276 | 5/1967 | Penney | 441/68 |
| 3,378,275 | 4/1968 | Rockwood et al. | 441/79 |
| 4,207,829 | 6/1980 | Meister et al. | 114/245 |
| 4,320,546 | 3/1982 | Knox | 441/74 |
| 4,439,166 | 3/1984 | Maxwell | 441/79 |

FOREIGN PATENT DOCUMENTS

| | | | |
|---|---|---|---|
| 61878 | 10/1982 | European Pat. Off. | 441/74 |
| 2516472 | 11/1981 | France | 441/74 |

*Primary Examiner*—Jeffrey V. Nase
*Assistant Examiner*—Jesûs D. Sotelo
*Attorney, Agent, or Firm*—Merchant, Gould, Smith, Edell, Welter & Schmidt

[57] ABSTRACT

A water ski or similar equipment comprising a platform 10 having a downwardly projecting fin, the fin 11 or the platform 10 having means for deflecting the water laterally of the direction of travel through the water, such means being, in one example, a pair of wedge shaped components 12, 13 secured at opposite sides of the fin 11 to present respective angled external surfaces.

7 Claims, 7 Drawing Figures

WATER SKIS AND THE LIKE

This invention relates to water skis and also to surfboards and sailboards. Such devices comprise a generally flat platform, projecting from the underneath surface of which is a fin or keel.

The invention has a particular, though not exclusive reference to water skis which are primarily intended for use in slalom competition, in which the skier changes direction rapidly but attempts to complete the slalom course in as fast a time as possible. Such competition gives special problems, including the need to take corners as sharply as possible, but at speed, to decelerate at certain times and not others, and to enable body balance to be maintained in the best way to enable a fast time to be achieved for a given course.

Factors enabling these requirements to be met can also contribute to more efficient skiing at slower speed and can thus work to the advantage of the novice, or less experienced skier, as well as to others not actually involved in slalom competition skiing.

Similar considerations apply to surfboards and, to a lesser extend, to sailboards.

Attempts have been made to improve on the performance of water skis, including providing grooves or other shapes applied to the underneath surface of the platform, but none of those arrangements have been found to be particularly effective, especially in water skis used for slalom events.

It is the object of the invention to provide a water ski or similar equipment with means which will enable the requirements mentioned, to be met at least to some degree.

In accordance with the present invention there is provided water ski or similar equipment comprising a platform having a fin attached to the platform to project downwardly in a position of use, characterised by means on the fin or on the platform arranged to deflect water laterally of the direction of travel, in use, said means comprising a pair of surfaces set at acute angle with respect to the length of the platfomr and the forward ends of said surfaces being nearer together than their rear ends.

The invention will now be described by way of example with reference to the accompanying drawings in which.

Figure 1:
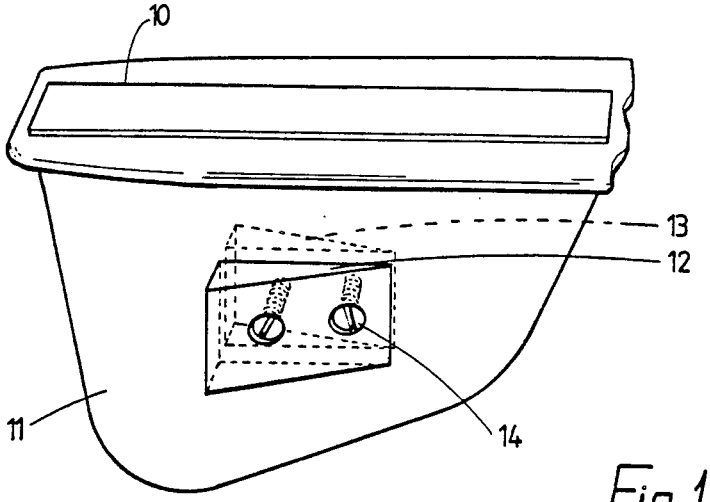
FIG. 1 is a view of part of a water ski constructed in accordance with the present invention.

The examples illustrated in the drawings are all concerned with water skis of the kind particularly intended for use in slalom competition events. However, water skis for other purposes may also benefit from devices in accordance with the invention as described and they may also be applied to surfboards where similar conditions may be applicable. They may also be applied to sailboards though the operating conditions and requirements are somewhat different.

Figure 2:
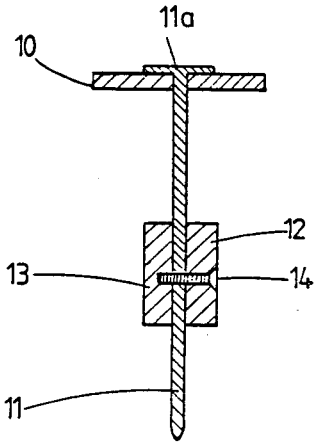
FIG. 2 is a cross sectional view through the ski shown in FIG. 1.

The construction shown in FIGS. 1 and 2 is applied to a water ski comprising a generally flat platform 10 from the underneath surface of which projects a blade-like fin 11. This underneath surface may be flat or, sometimes curved in section. In the example shown, this occupies a slot in the platform 10 and has a flange 11*a* by means of which it is secured at the upper surface of the platform. It is to be understood that a number of different platform and fin shapes can be used and also that the position of the fin on the platform may be other than that illustrated. Nevertheless, in most cases, the fin is situated at or near to the rear end of the platform and projects downwardly in a plane which is perpendicular to the general plane of the platform. The fin is substantially flat although its edge may be chamfered as shown.

Secured to opposite flat surfaces of the fin are wedge pieces 12, 13. Screws 14 pass from one wedge piece 12 through the fin to the other wedge piece 13 to hold the two wedge pieces firmly in place. The external vertical side faces of the wedge pieces 12, 13 form respective flat surfaces which are at acute angles to the plane of the fin. Since the fin lies on the longitudinal centre line of the platform, the surfaces are thus equi-angularly positioned with respect to the ski longitudinal axis.

It is found in practice that when the ski is travelling through the water with the platform in a generally horizontal plane the wedges 12, 13 will tend to produce a breaking effect by parting the water as it flows past the fin. The effect will be the same on both sides.

However, as the ski is tilted to one side or the other for the purpose of making a turn, the effects of the two wedges will differ. The upper of the two wedges will have little effect since the water above it will quickly rise to the surface and therefore there will be little breaking effect on the ski. The lower wedge, however, will tend to lift the rear of the ski thus enabling the front to be lower in the water. The effect is to increase the turning force on the ski so that corners can be taken extremely rapidly.

Figure 3:
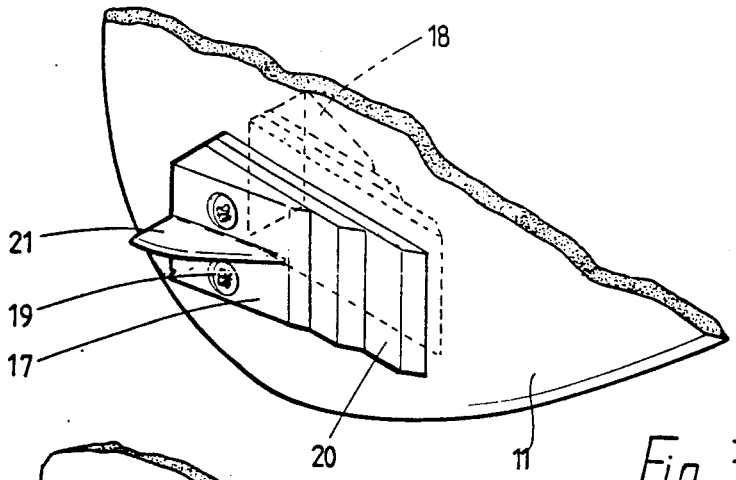
FIG. 3 is a view of a portion of a water ski fin having a further alternative form of the invention.

FIG. 3 shows a further alternative arrangement in which angled surfaces are formed at the two sides of a fin 11. Wedge shaped pieces 17, 18 are secured to the opposite sides of the fin 11 by means of screws 19. However, between the wedge shaped pieces 17, 18 and the fin there are shown spacers 20, each being in the form of a flat piece with an angled front edge. The spacers are of different lengths and, as illustrated, two spacers 20 are positioned between each wedge shaped piece 17, 18 and the fin 11 respectively. It is, however, possible to use the wedge shaped pieces 17, 18 without any spacers or with more or less than the two spacers 20 shown. It is also possible to use different numbers and sizes of spacers on the two opposite sides of the fin. The effect of using different numbers or sizes of spacers will produce different cornering characteristics when the ski is angled to one side or the other. It is well known that individual skiers develop the ability to make turns in one direction more efficiently than the other. By choosing appropriate wedges for the two sides, this inequality can be alleviated.

The wedge shaped pieces 17, 18 also incorporate horizontal wings 21. These extend laterally of the respective wedge surfaces and are thus parallel to the platform. These have the effect of stabilising the rear of the ski as it travels through the water both when it is travelling horizontally and during turning.

Figure 4:
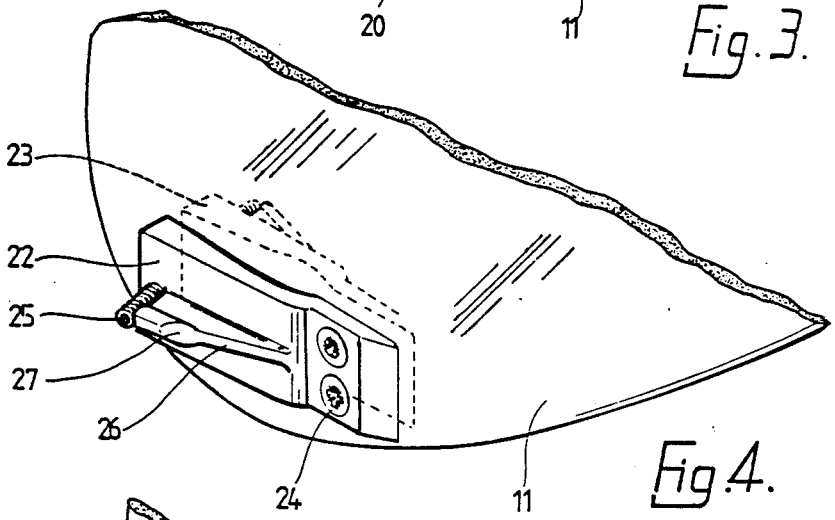
FIG. 4 is a view of part of a water ski fin having a further alternative construction in accordance with the invention.

The construction shown in FIG. 4 includes two pieces 22, 23 secured at opposite sides of the fin 11 respectively. The front end of each such piece is secured by screws 24 passing from one piece through the fin 11 to the other piece. At the rear end of each piece 22, 23 there is an adjusting screw 25 shown as a grub screw which is engaged in the rear of the piece and can bear against the adjacent fin surface. Screwing in of the screws 25 causes the pieces to be flexed about the regions adjacent to the screws 24 at the front end thus changing the angle of the external surface of each such piece relatively to the longitudinal axis of the ski. It is possible to adjust the two screws 25 equally or unequally to produce the same or differing effects at opposite sides of the fin.

The pieces 22, 23 also incorporate lateral wings 26 each terminating in an enlargement 27. These wings not only serve the purpose described above in relation to the wings 21 on the FIG. 3 construction, but also serve to support and partially mask the adjusting screws 25.

Figure 5:
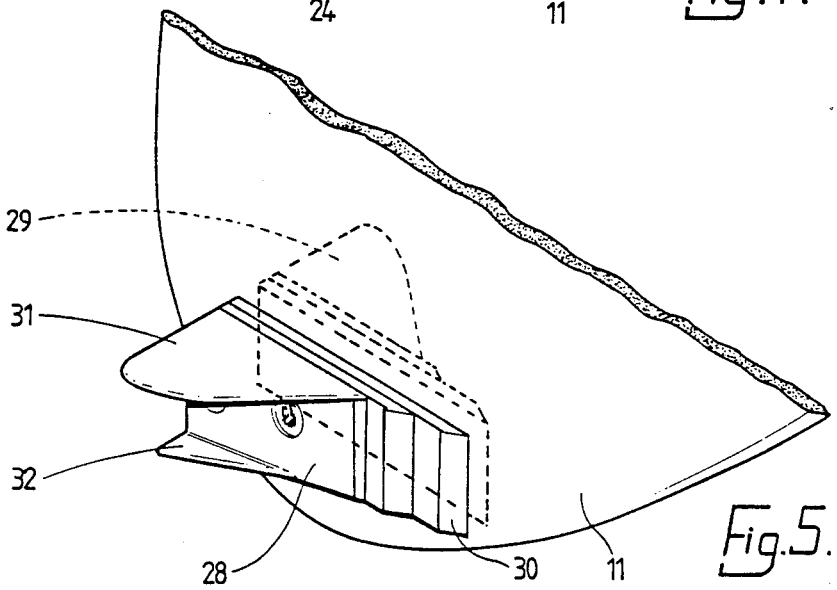
FIG. 5 is a part of a water ski fin having a still further construction in accordance with the invention.

FIG. 5 shows a still further alternative construction in which wedge shaped pieces 28, 29 are secured to opposite sides of the fin 11. Spacers 30 are also shown. Each wedge shaped piece, however, has two wings 31, 32 which are formed along the upper and lower edges of the wedge shaped piece. The upper wing, 31 is larger than the lower 32. These wings are also intended to produce stabilising effects. In an alternative arrangement the wings are fixed and the wedge shaped pieces can be adjusted between them, adjustment being by any of the methods described herein.

Figure 6:
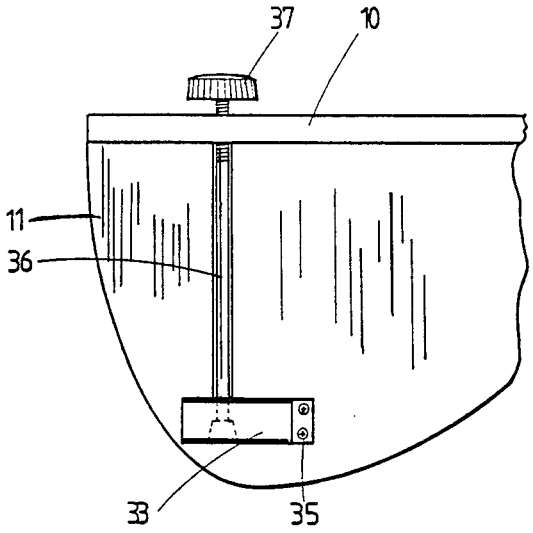
FIG. 6 is a view of the rear of a water ski showing a still further construction in accordance with the invention.
Figure 7:
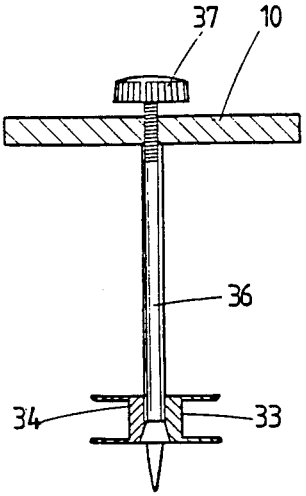
FIG. 7 is a cross sectional view of a construction in FIG. 7.

FIGS. 6 and 7 show the rear end of a water ski in which a fin 11 is secured at the rear end of the platform 10. At opposite sides of the fin 11, wedge shaped pieces 33, 34 are fitted. The front end of each such piece is secured by screws 35 and the region adjacent to these can be flexed. Near their rear ends the wedge shaped pieces 33, 34 have internally facing inclined surfaces, which are thus presented towards one another. Engaged between these is a rod 36 carrying a part with inclined sides and which is non-rotatable. This arrangement comprises wedging means whereby the raising and lowering of the rod 36 causes the part to be raised or lowered between the wedge shaped pieces 33, 34 to move them towards and away from one another. This arrangement can be seen in FIG. 7. The upper end of the rod 36 passes through the platform 10 and carries a control knob 37 whereby the rod 36 can be rotated. The rod is screw threaded to engage in a corresponding screw thread in the platform 10 as shown so that rotation of the rod 36 by means of the knob 37 causes raising and lowering the rod 36 either in a position accessible above the platform or not.

Other alternative arrangements are possible to allow adjustment of the surfaces in the various constructions. Either the angle of the surfaces or their spacing from the longitudinal axis of the ski can be altered or both.

I claim:

1. Water ski equipment comprising a platform, a fin attached to the platform to project downwardly, in a position of use and means on the fin arranged to deflect water laterally of the direction of travel, in use, said means defining a pair of surfaces set at acute angles with respect to the plane of the fin and the front ends of such surfaces being nearer together than their rear ends, the surfaces being independently adjustable.

2. Water ski equipment comprising a platform, a fin attached to the platform to project downwardly, in a position of use and means on the fin arranged to deflect water laterally of the direction of travel, in use, said means defining a pair of surfaces set at acute angles with respect to the plane of the fin, the front ends of such surfaces being nearer together than their rear ends, wherein laterally extending wings are situated adjacent to the respective surfaces.

3. Water ski equipment comprising a platform, a fin attached to the platform to project downwardly, in a position of use and means on the fin arranged to deflect water laterally of the direction of travel, in use, said means defining a pair of surfaces set at acute angles with respect to the plane of the fin, the front ends of such surfaces being nearer together than their rear ends, further comprising components on which said surfaces are formed respectively, said components being wedge shaped parts, spacers being arranged to be positioned relatively to the wedge shaped parts to increase their respective spacing relatively to a longitudinal axis of the platform.

4. Water ski equipment comprising a platform, a fin attached to the platform to project downwardly, in a position of use and means on the fin arranged to deflect water laterally of the direction of travel, in use, said means defining a pair of surfaces set at acute angles with respect to the plane of the fin, the front ends of said surfaces being nearer together than their rear ends, further comprisng components on which the surfaces are formed respectively, each of the components being fixed at the front end to the fin and carrying adjusting screw means at the rear end, actuation of said adjusting screw means resulting in flexing of the component to vary the angle of the external surface thereof.

5. Water ski equipment comprising a platform, a fin attached to the platform to project downwardly in a position of use, means on the fin arranged to deflect water laterally of the direction of travel in use, said means comprising components defining a pair of surfaces respectively set at acute angles with respect to the plane of the fin and the front ends of said surfaces being nearer together than their rear ends, said components being attached to opposite sides of the fin respectively, wherein the components are attached to the fin through a wedging device, movable relatively to the components to move them away from one another and towards one another, to vary the angles of the external surfaces.

6. Water ski equipment comprising a platform, a fin attached to the platform to project downwardly, in a position of use, means on the fin arranged to deflect water laterally of the direction of travel in use, said means comprising components defining a pair of surfaces respectively set at acute angles with respect to the plane of the fin and the front ends of said surfaces being nearer together than their rear ends, said components being attached to opposite sides of the fin respectively, wherein the components are attached to the fin through a wedging device positioned between the rear ends of the two components, the front ends being secured to the fin, the wedging device being moved, to adjust the surfaces simultaneously, in a direction transverse to the direction of adjustment to move the components towards and away from one another, to vary the angles of the external surfaces.

7. Water ski equipment comprising a platform, a fin attached to the platform to project downwardly, in a position of use, means on the fin arranged to deflect water laterally of the direction of travel in use, said means comprising components defining a pair of surfaces respectively set at acute angles with respect to the plane of the fin and the front ends of said surfaces being nearer together than their rear ends, said components being attached to opposite sides of the fin respectively, wherein the components are attached to the fin through a wedging device connected to a control which projects to the upper surface of the platform.

* * * * *